United States Patent [19]

Mikami

[11] 4,367,437

[45] Jan. 4, 1983

[54] REFERENCE VOLTAGE GENERATOR

[75] Inventor: Tsukasa Mikami, Gyoda, Japan

[73] Assignee: Takeda Riken Kogyo Kabushikikaisha, Tokyo, Japan

[21] Appl. No.: 118,226

[22] Filed: Feb. 4, 1980

[30] Foreign Application Priority Data

Feb. 13, 1979 [JP] Japan ..... 54-15266

[51] Int. Cl.[3] ..... G05F 1/46

[52] U.S. Cl. ..... 323/349; 307/264; 323/267; 323/280; 323/281; 328/173

[58] Field of Search ..... 323/267, 273, 274, 280, 323/281, 313, 314, 349; 330/85, 98, 110, 127; 307/264, 296 R, 297; 328/168, 172, 173

[56] References Cited

U.S. PATENT DOCUMENTS 3,432,763 3/1969 Ingman ..... 330/85 X
3,772,604 11/1973 Hogg et al. ..... 330/110 X
3,794,931 2/1974 Albrecht et al. ..... 330/110 X
3,805,145 4/1974 Gordon ..... 323/280
4,145,664 3/1979 Takaoka et al. ..... 330/85

*Primary Examiner*—A. D. Pellinen
*Attorney, Agent, or Firm*—Staas & Halsey

[57] ABSTRACT

The output from a reference voltage source is provided to a DC amplifier and its output is applied as a reference voltage to an output terminal. The output thus derived at the output terminal and the output from the reference voltage source are changed over by a switch to be alternately supplied to a smoothing circuit, the smoothed output from which is fed back to the DC amplifier. The switch is changed over periodically by a control signal from a control circuit, and by controlling the change-over ratio of the switch, a reference voltage of a desired value is provided at the output terminal. Thereafter, when the output voltage at the output terminal deviates from the reference value, the deviation is corrected by the feedback action.

32 Claims, 14 Drawing Figures

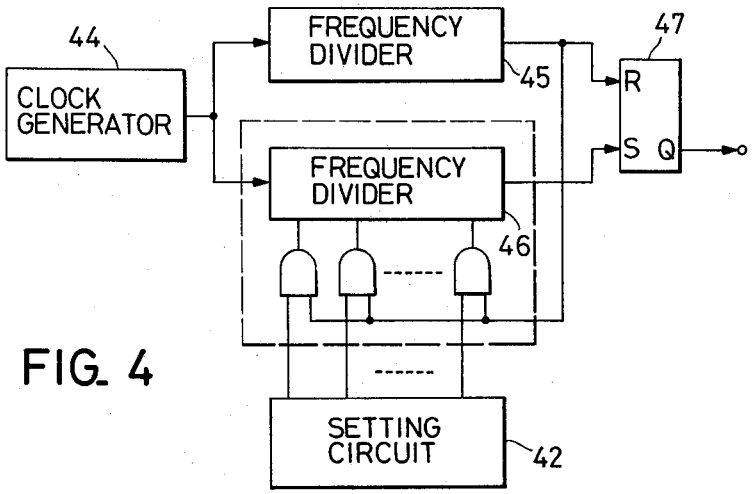
FIG. 4
FIG. 5
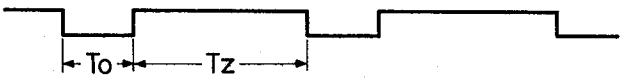
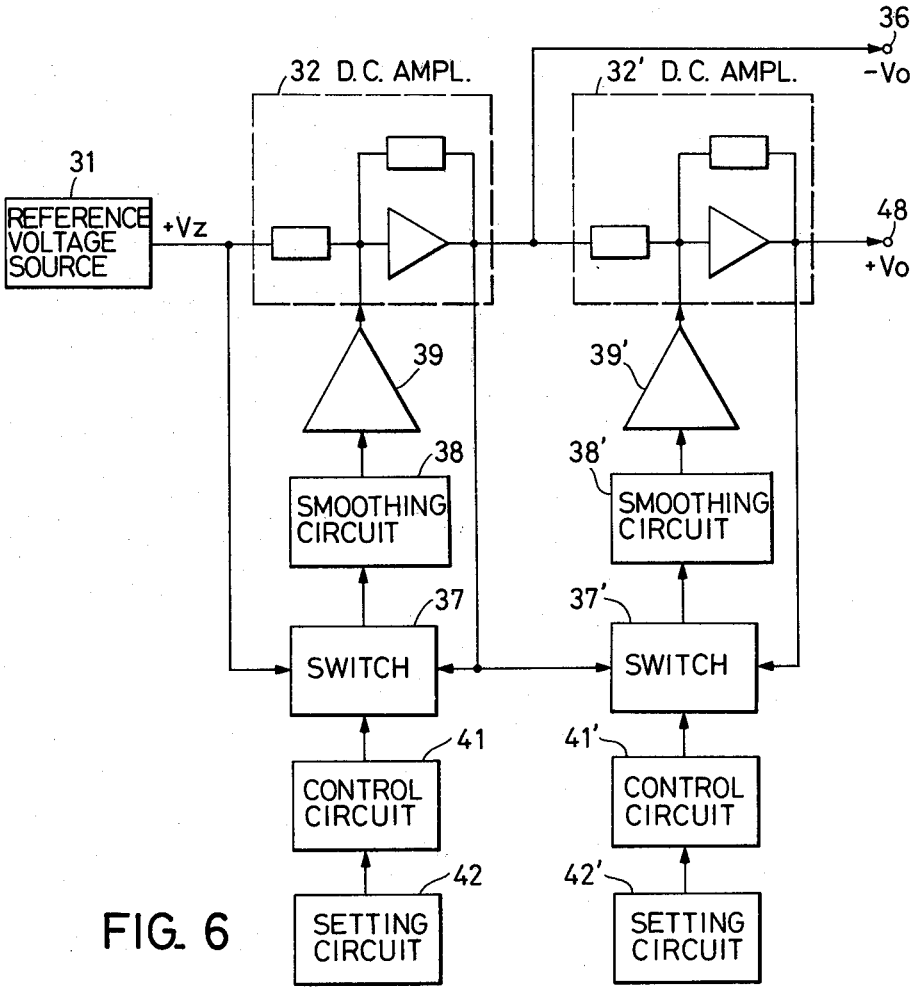
FIG. 6

REFERENCE VOLTAGE GENERATOR

BACKGROUND OF THE INVENTION

This invention relates to a reference voltage generator which provides a predetermined DC voltage correctly and stably from a constant DC voltage.

For example, a converter for converting a digital signal to an analog signal, a converter for converting an analog signal to a digital signal and other various types of converters require a reference voltage, and the accuracy of such equipment may sometimes depend on the accuracy of the reference voltage; therefore, it is important to obtain a highly accurate, stable reference voltage.

In a conventional reference voltage generator, a constant voltage is obtained by a Zener diode and amplified by a variable gain DC amplifier, and its gain is adjusted to obtain a reference voltage of a predetermined magnitude. Accordingly, it is necessary to set up the gain of the DC amplifier with high accuracy, and the setting of the gain is effected by controlling the resistance value of a resistor used in the amplifier. In order to obtain a resistor having a correct resistance value, it is necessary to regulate the resistance value, and since the resistance value is affected by temperature variations, if a winding resistor of high stability is employed, the circuit arrangement becomes bulky and expensive. In the case of using a thin film resistance element, the adjustment of its resistance value requires special equipment and much trouble, and on top of that, the resistance value is subject to the influence of a temperature change. Thus, the DC amplifier is pre-adjusted and is difficult to re-adjust. Consequently, since there is dispersion in the constant voltage value available from the Zener diode, if the Zener diode breaks down, it is necessary to replace the reference voltage generator in its entirety with a new one.

SUMMARY OF THE INVENTION

It is an object of this invention to provide a reference voltage generator which is capable of providing easily a correct reference voltage even if the voltage of a reference voltage source is not at a predetermined value or varies due to temperature change or with the lapse of time.

Another object of this invention is to provide a reference voltage generator which is able to correctly produce a constant reference voltage irrespective of temperature variations or aging of a DC amplifier used for amplifying the output from a reference voltage source.

Yet another object of this invention is to provide a reference voltage generator which is capable of producing a stable reference voltage and which is easy to fabricate as an integrated circuit.

Also in the present invention, use is made of a reference voltage source employing, for example, a Zener diode element or the like and its output voltage is amplified by a DC amplifier. The gain of this amplifier may be unity. In accordance with this invention, the output from the DC amplifier and the output from the reference voltage source are alternately switched with selected periods by a switch and the output from the switch is rendered by a smoothing circuit into a DC voltage which is negatively fed back to the DC amplifier, thereby to ensure that a constant reference voltage is obtained at the output side of the reference voltage source. The switch for changing over (alternating the contact of the switch between) the outputs from the DC amplifier and the reference voltage source is controlled by a control signal derived from a control circuit, and the changeover ratio of the switch placed under the control of the control circuit is dependent on the set value of setting means. This set value is made variable; namely, by changing the set value, voltage variations of the reference voltage source itself and variations in the gain of the amplifier, for example, are compensated for. By using an integrating amplifier as the DC amplifier for integrating and amplifying the output from the switch, the function of the smoothing circuit can also be obtained.

Alternatively, the output from the reference voltage source is amplified by the DC amplifier; the amplified output and the ground potential are selectively provided via a switch to the smoothing circuit; and the difference between the output from the smoothing circuit and the output from the reference voltage source is detected by a difference detector and then negatively fed back to the DC amplifier. In this case, the difference detector may also be omitted by changing over (alternating contact between) the output from the DC amplifier and an inverted signal of the output from the reference voltage source with the switch. Also, it is possible to give the integrating function to the DC amplifier, to change over the ground potential and the amplifier output by the switch and to integrate and amplify the switch output by the DC amplifier up to the output standard of the reference voltage source. In any case, deviations of the gain of the amplifier and so forth can be corrected by adjusting the duty ratio of the switch control signal.

Figure 2:
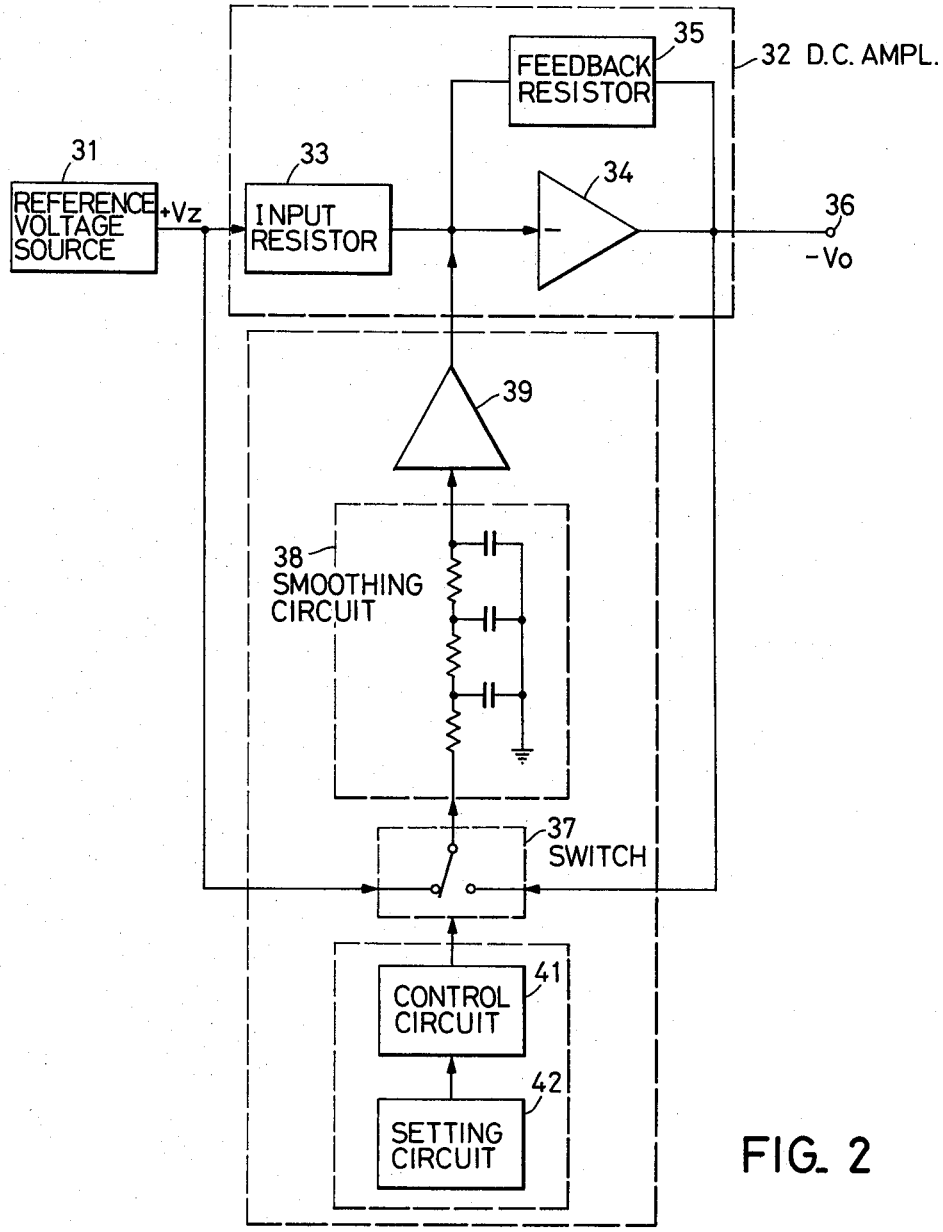
FIG. 2 is a block diagram illustrating an embodiment of the reference voltage generator of this invention.
Figure 7:
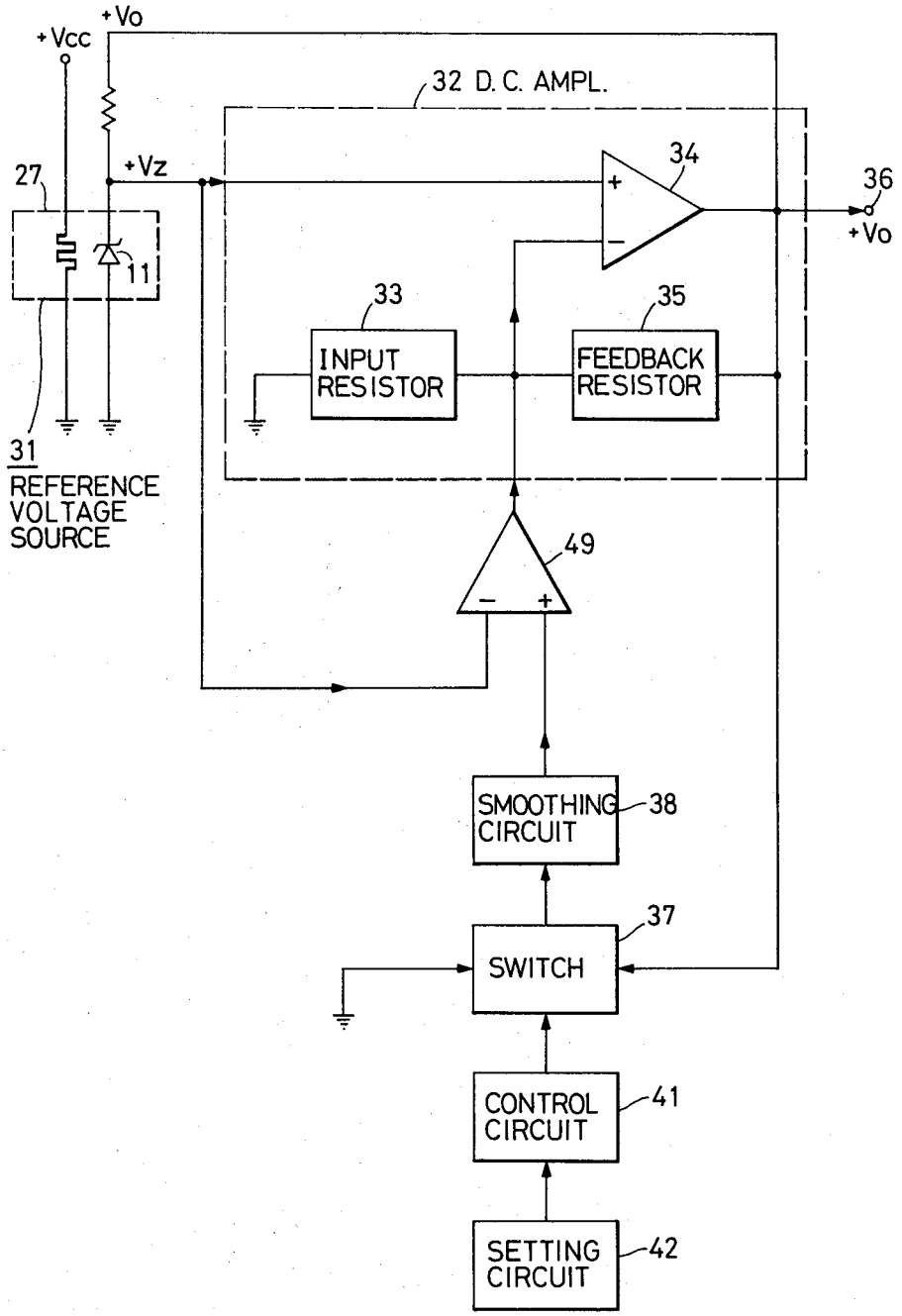
Figure 8:
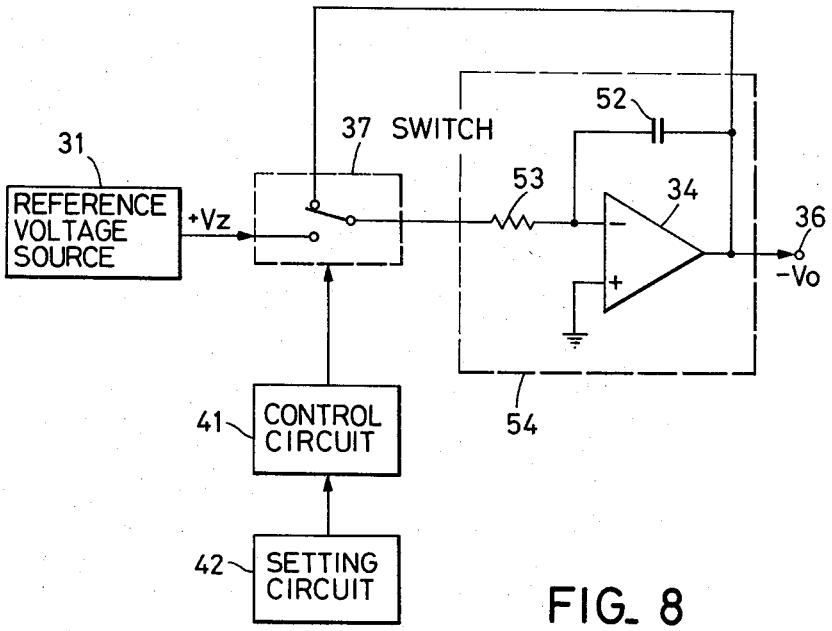
Figure 9:
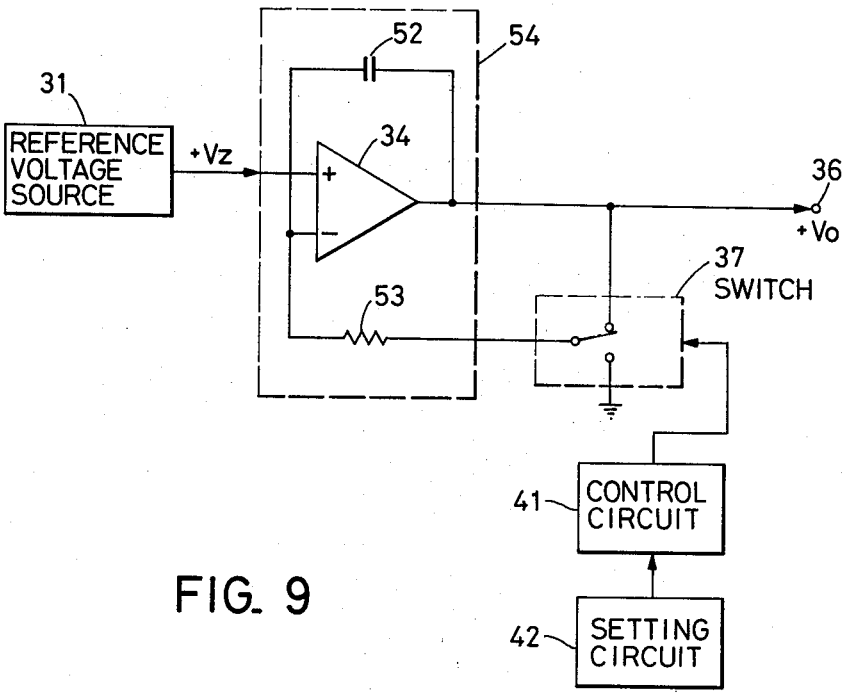
Figure 10:
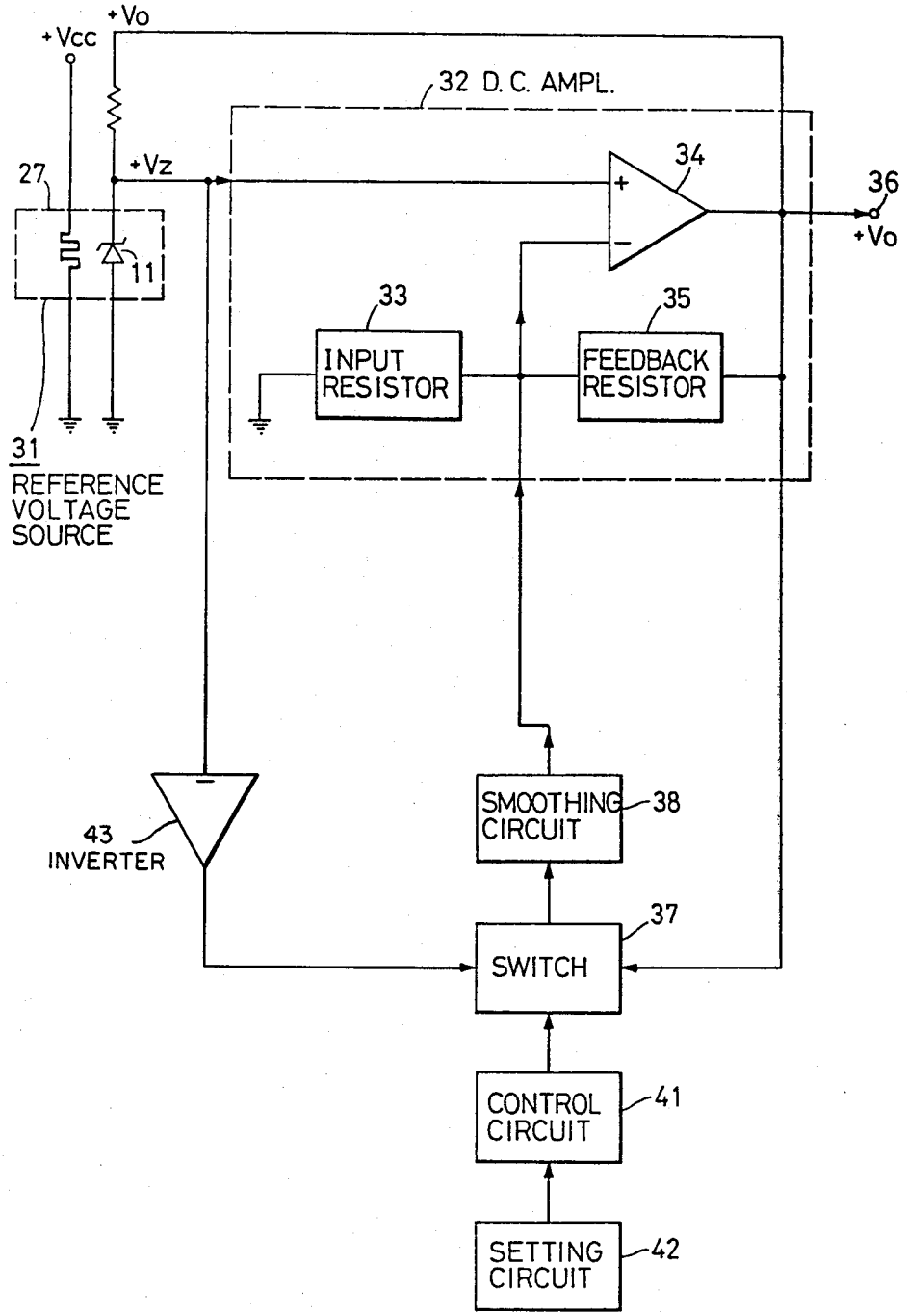
Figure 11:
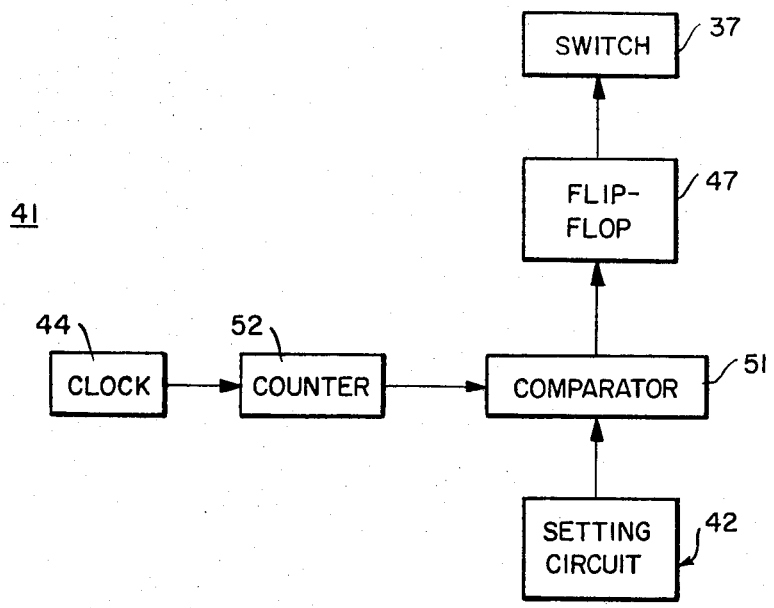
Figure 12:
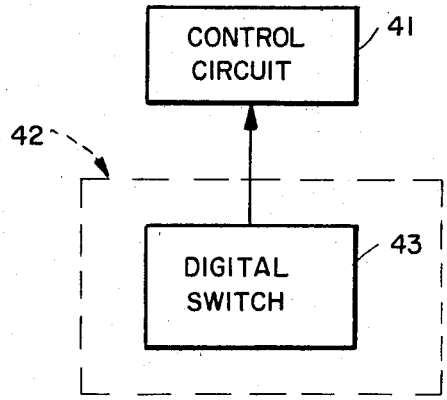

FIGS. *3a*, *3b* and *3c* show a series of waveforms explanatory of the operation of the reference voltage generator shown in FIG. 2;

FIG. 4 is a block diagram showing an example of a control circuit 41 used in FIG. 2;

FIG. 5 is a waveform diagram showing an output waveform of the control circuit depicted in FIG. 4;

FIG. 6 is a block diagram illustrating another embodiment of the reference voltage generator of this invention which is designed to obtain a reference voltage of different polarity than the polarity of the output from a reference voltage source, as well as a reference voltage of the same polarity as the reference voltage source;

FIG. 7 is a block diagram illustrating another embodiment of the reference voltage generator of this invention which is adapted to obtain a reference voltage of the same polarity as the output from the reference voltage source; and FIG. 8 is a connection diagram showing an example of a DC amplifier equipped with the function of a smoothing circuit;

FIG. 9 is a connection diagram illustrating another example of the DC amplifier with a smoothing function;

FIG. 10 shows another embodiment of the present invention;

FIG. 11 shows one embodiment of the control circuit 41 of the present invention; and FIG. 12 shows one embodiment of the setting circuit 42 of the present invention.

DESCRIPTION OF THE PREFERRED EMBODIMENTS

Figure 1:
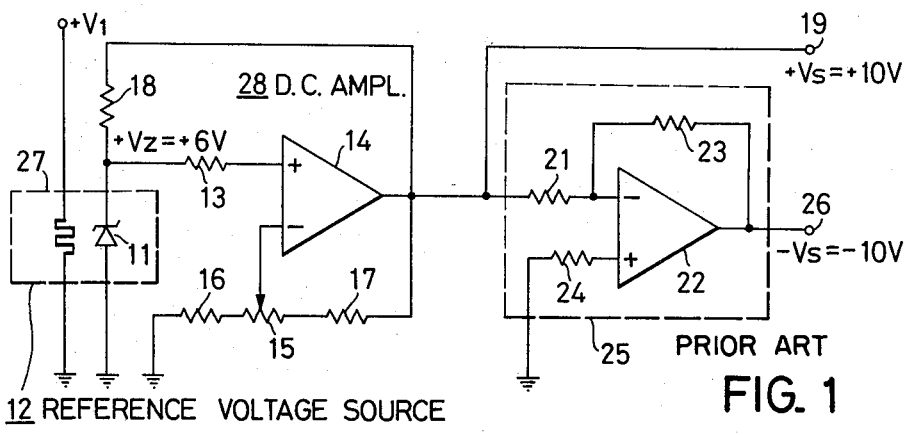
FIG. 1 is a connection diagram showing a conventional reference voltage generator.

To facilitate a better understanding of the present invention, a description will first be given, with reference to FIG. 1, of a conventional reference voltage generator.

A voltage generated by a reference voltage source 12, which is formed by a Zener diode or like constant voltage element 11, is provided via a resistor 13 to one input of an operational amplifier 14. The other input of the operational amplifier 14 is connected to a moving element of a variable resistor 15, which is grounded at one end via a resistor 16 and connected at the other end to the output side of the operational amplifier 14 via a resistor 17. The output of the operational amplifier 14 is connected via a resistor 18 to the connection point of the Zener diode 11 and the resistor 13, supplying a current to the Zener diode 11 via the resistor 18.

The output end of the operational amplifier 14 is used as an output terminal, at which is derived a constant positive reference voltage. The voltage at the terminal 19 is supplied via a resistor 21 to an inverting input side of an operational amplifier 22. Between the output side of the operational amplifier 22 and its inverting input side is connected a feedback resistor 23, and a non-inverting input side of the operational amplifier 22 is grounded via a resistor 24. Thus, an inverting amplifier 25 is constituted, and the voltage at the terminal 19 is inverted and amplified by the inverting amplifier 25 to provide a negative reference voltage at its output terminal 26.

The Zener diode 11 is placed, for example, in an oven 27 wherein it is held stable in terms of temperature. A stable Zener diode voltage thus obtained, for instance, 6 V, is amplified, for example, 1.66 times by a DC amplifier 28 including the operational amplifier 14, providing a voltage of 10 V at the output terminal 19. In this case, if the variable resistor 15 is not taken into account, the gain of the DC amplifier 28 is such a value that the sum of the resistance values of the resistors 16 and 17 is divided by the resistance value of the resistor 16, and a voltage obtained by multiplying this value by the Zener voltage of the Zener diode 11 is provided as an output voltage. The gain of the inverting amplifier 25 is equal to the resistance value of the resistor 23 divided by the resistance value of the resistor 21; and these resistance values are selected such that the gain is 1.

In such a reference voltage generator, it is desired in some cases to obtain, for example, +10.0000 V and −10.0000 V stably at the output terminals 19 and 26, respectively. In practice, however, even if the DC amplifier 28 is preset to yield a predetermined output with accuracy, it is difficult to maintain the DC amplifier 28 in its preset state due to temperature variations or secular variations in the resistance values of the resistors 16 and 17, the drift of the operational amplifier and so forth. For instance, the temperature coefficient of the Zener voltage of the Zener diode is 0.3 ppm/°C. and its variation in six months is 10 ppm. The temperature coefficient of the output available at the output terminal 19 is dependent mainly on the temperature coefficients of the resistors 16 and 17 and is 3 ppm/°C., and its variation is 20 ppm in six months. This is the sum of secular variations in the Zener voltage and the resistance values of the resistors 16 and 17. The temperature coefficient of the output at the terminal 26, added with the temperature coefficient of the amplifier 25 (which depends mainly on the resistors 21 and 23), is 6 ppm/°C. and its variation amounts to 30 ppm in six months.

In such a prior art reference voltage generator, the Zener diode 11, which forms its principal part, is itself subject to temperature and secular variations, which causes a change in the output voltage, and the temperature and secular variations are further increased by the DC amplifiers 28 and 25. The above numerical values are those obtainable with a reference voltage generator of the highest stability which employs winding resistors in the amplifiers.

But a winding resistor is difficult to fabricate as an integrated circuit, and in the case of using an integrated circuit, a thin film resistance element is usually employed; however, the thin film resistance element is poor both in the temperature variation and in the variation with the lapse of time. Moreover, it is also difficult to easily obtain a thin film resistance element of a correct resistance value in its initial state. In the prior art, the general practice is to burn off a part of the thin film resistance element by laser, i.e. by laser trimming to obtain a correct resistance value. But such laser trimming itself is very troublesome and requires special equipment, and the resistance film left unremoved after trimming is liable to be distorted by heat and vary with the lapse of time.

Even if the initial value of the reference voltage generator is adjusted to be correct, it cannot be free from temperature variations and secular variations, and readjustment for such variations, for example, by a variable resistor is difficult; further, fine control is very difficult. Moreover, if it is attempted to replace the reference voltage source, for example, the Zener diode due to its breakdown, the overall gain and the like of the equipment must be adjusted, so that it is essentially impossible to substitute the Zener diode alone with a new one; consequently, the whole reference voltage generator must be replaced with a new one.

FIG. 2 illustrates an embodiment of the reference voltage generator of this invention, in which a reference voltage source 31 can be formed by a Zener diode or like constant voltage element, as is the case with the reference voltage source 12 described previously in respect of FIG. 1. The output from the reference voltage source 31 is applied to an inverting type DC amplifier 32 in the present embodiment. That is to say, the output from the reference voltage source 31 is provided via an input resistor 33 to an inverting input side of an operational amplifier 34, and the inverting input side is connected via a negative feedback resistor 35 to the output side of the operational amplifier 34. From the output of the inverting type DC amplifier 32 is led out an output terminal 36, from which is derived a desired reference voltage.

In the present invention, the output from the reference voltage source 31 and the output from the DC amplifier 32 are provided to a switch 37 and selectively applied therethrough to a smoothing circuit 38. The DC output from the smoothing circuit 38 is fed back to the DC amplifier 32, if necessary, via an amplifier 39. Namely, the output from the amplifier 39 is supplied to the inverting input side of the operational amplifier 34. The smoothing circuit 38 is shown to be formed by three stages of RC low-pass filters, but they may also be replaced with active filters from the standpoint of fabrication as an integrated circuit.

Figure 3A:
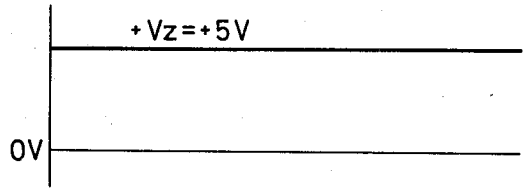
Figure 3B:
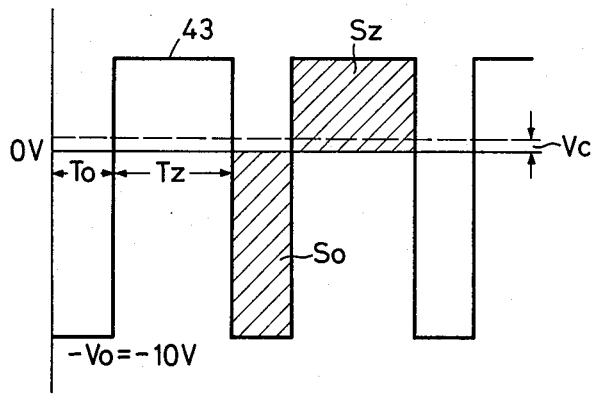
Figure 3C:
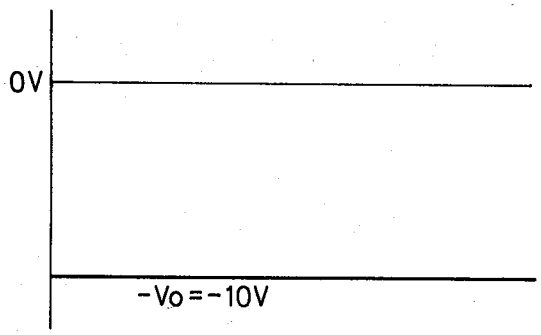

The switch 37 is controlled by a control circuit 41. The change-over ratio (that is, the ratio of the alternating connection periods) of the switch 37 depends on the set value of a setting circuit used as setting means. Now, let it be assumed that the output +Vz from the reference voltage source 31 is +5 V as shown in FIG. 3A and that the output voltage −Vo at the terminal 36 is −10 V as shown in FIG. 3C. In this case, letting Tz represent the period during which the smoothing circuit 38 is connected to the side of the reference voltage 31 via the switch 37 and To represent the period during which the smoothing circuit 38 is connected to the DC amplifier 32 via the switch 37, as shown in FIG. 3B, the periods Tz and To are selected so that Vo=Vz×(Tz/To). Accordingly, in the case where the output voltage Vo is twice as large as the voltage Vz in terms of absolute value, as in the illustrated example, the period Tz during which the switch 37 is connected to the side of the reference voltage source 31 is selected to be twice as long as the period To during which the switch 37 is connected to the DC amplifier 32. As a consequence, the output from the switch 37 assumes for example a waveform as indicated by a curve 43 in FIG. 3B, and if the output voltage Vz from the reference voltage source 31 and the output voltage Vo at the output terminal 36 respectively have the correct values that are desired to be obtained, the DC output Vc from the smoothing circuit 38 is zero.

The switch 37 can be alternately changed over by the control circuit 41 with high accuracy, and the control circuit 41 can be constructed, for example, as shown in FIG. 4. That is, very stable clock pulses are generated by a clock generator 44 and frequency divided by frequency dividers 45 and 46, each formed by a counter. The frequency ratios of the frequency dividers 45 and 46 may be selected to be the same, but upon each occurrence of the output from the frequency divider 45, the value set in a setting circuit 42 is preset in the frequency divider 46, and at the same time, a flip-flop 47 is reset. Consequently, the Q output from the flip-flop 47 becomes low-level as shown in FIG. 5 upon each occurrence of the output from the frequency divider 45, and the set value of the setting circuit 42 is set in the frequency divider 46, so that the frequency divider 46 yields an output before the frequency divider 45 provides the next output pulse. By this output, the flip-flop 47 is set and its Q output becomes high-level as depicted in FIG. 5.

The Q output from the flip-flop 47 is applied as a control signal to the switch 37, and during the period To that the Q output is low-level, the switch 37 is connected to the side of the DC amplifier 32, and during the period Tz that the Q output is high-level, the switch 37 is connected to the side of the reference voltage source 31. Accordingly, a change in the set value of the setting circuit 42 causes a change in the ON-OFF ratio between the low and the high level of the output from the flip-flop 47, that is, its duty ratio, resulting in the change-over ratio of the switch 37 being altered.

Now, assume that an ideal voltage is being derived from the reference voltage source 31. In such a state, if the resistance values of the resistance elements 33 and 35 of the DC amplifier 32 vary due to a temperature change, secular change or by some cause to decrease, for example, the gain of the DC amplifier 32, the area Sz of the period Tz during which the switch 37 is connected to the side of the reference voltage source 31 becomes larger than the area So of the period To during which the switch 37 is connected to the side of the DC amplifier 32. As a result of this, the output from the smoothing circuit 38 increases on the positive side, and this output is provided to the DC amplifier 32 to compensate for a deviation of the output voltage at the output terminal 36 from a reference value. In this way, the drift of the operational amplifier 34 or variations in the resistance values of the resistors 33 and 35 in the DC amplifier 32 are automatically compensated for to ensure that a correct reference voltage is provided at the output terminal 36 at all times.

Furthermore, in the case where the gain of the DC amplifier 32 is not predetermined in its initial state, for example, in the case where the resistance values of the resistors 33 and 35 are not correctly adjusted, the output from the smoothing circuit 38 does not become zero from the beginning, and there is produced at the output terminal 36 a correct output which compensates for a deviation of the gain of the DC amplifier 32.

When the voltage Vz of the reference voltage source 31 is not correctly at its reference value, a faulty voltage is yielded at the output terminal 36. In the present invention, however, a digital voltmeter or the like is connected to the terminal 36 prior to the use of the reference voltage generator and the set value for the setting circuit 42 is changed to bring the output at the output terminal 36 to a desired reference voltage while observing an indication on the voltmeter or the like. That is, the setting circuit 42 is formed not only by a register but also by at least one so-called digital switch 43 (FIG. 12), and the digital switch is manually reset, while observing the voltage at the output terminal 36, until it becomes a desired value; namely, even if the output voltage from the reference voltage source 31 is different from its predetermined value, it can be corrected. Accordingly, the reference voltage source 31 can be replaced with a new one, and voltage fluctuations of the reference voltage source 31 due to a temperature change or with the lapse of time can easily be corrected.

In FIG. 2, the amplifier 39 is used to lower the output impedance and amplify the output but may also be left out. In the embodiment of FIG. 2, a negative reference voltage is obtained at the output terminal 36 with respect to the positive output from the reference voltage source 31; in order to obtain a positive reference voltage, use is made of, for example, such a circuit arrangement as shown in FIG. 6. The output at the reference voltage output terminal 36 is supplied to an inverting amplifier 32' having a gain of 1, and the voltage yielded at its output terminal 48 and the voltage at the terminal 36 are changed over by a switch 37' as is the case with the foregoing embodiment, and the switch output is smoothed by a smoothing circuit 38', thereafter being fed back to an amplifier 32' via an amplifier 39'. The switch 37' is placed under the control of a control circuit 41' and its set value is changed by a setting circuit 42'. In this case, since the gain of the amplifier 32'is 1, the change-over ratio of the switch 37' is selected to be substantially 1 and this change-over ratio needs to be changed only a little for a gain correction.

In FIG. 2, the reference voltage produced is opposite in polarity to the output voltage from the reference voltage source 31, but it is also possible to directly obtain a reference voltage of the same polarity as the output voltage from the reference voltage source 31. FIG. 7 illustrates an example of a circuit arrangement therefor, in which parts corresponding to those in FIG. 2 are identified by the same reference numerals. For example, the reference voltage source 31 is formed by a Zener diode and its output voltage is provided to the non-inverting input side of the operational amplifier 34 in the non-inverting type DC amplifier 32. From the output side of the operational amplifier 34 is led out the output terminal 36. The switch 37 is changed over between the output at the output terminal 36 and the ground potential instead of the output from the reference voltage source 31, and the output from the switch 37 is applied to a difference detector 49 via the smoothing circuit 38. The difference detector 49 detects the difference between the outputs from the smoothing circuit 38 and the reference voltage source 31, and the detected difference output is fed back to the non-inverting amplifier 32, i.e. to the inverting input side of the operational amplifier 34. The DC amplifier 32 is grounded at the inverting input side via a resistor 33, and the inverting input side is connected via the feedback resistor 35 to the output side.

When the output from the reference voltage source 31 is ideal, the reference voltage at the output terminal 36 is lowered by the switch 37 and the smoothing circuit 38 in accordance with the gain of the non-inverting amplifier 32, and the smoothed and lowered output reference voltage is compared by the difference detector 49 with the voltage of the reference voltage source 31. If the output reference voltage at the terminal 36 is correct, the output from the difference detector 49 is zero. If the output reference voltage at the terminal 36 deviates from a predetermined value, however, the deviation is corrected. When the output voltage from the reference voltage source 31 deviates from its reference value, the deviation can be corrected by adjusting the set value while measuring the output voltage at the terminal 36 with a voltmeter. In FIG. 7, if use is made of a stable inverting amplifier which is not significantly affected by temperature or the like, the difference detector 49 can be omitted; in such a case, the output from the reference voltage source 31 is supplied through an inverter 43 (as shown in FIG. 10) to the other side of the switch 37, performing the same operation as in FIG. 2 to provide a correct output. Or, an inverter can be provided between the termianl 36 and the switch 37 instead of between the output of the reference voltage source 31 and the switch 37.

In FIG. 2, it is also possible to equip the DC amplifier 32 with an integrating function and omit the smoothing circuit 38. For example, as illustrated in FIG. 8, an integrating capacitor 52 is connected between the inverting input side and the output side of the operational amplifier 34; the inverting input side is connected via an input resistor 53 to the moving element of the switch 37, i.e. its output side; the non-inverting input side of the operational amplifier 34 is grounded; and its output side is connected to the terminal 36, thus constituting an integrating amplifier 54. The reference voltage source 31 is alternately isolated from the integrating amplifier 54. By the switch 37, the output from the reference voltage source 31 and the output at the terminal 36 are changed over and each of them is alternately applied to the integrating amplifier 54. The value of the time constant of the integrating amplifier 54 is selected to be sufficiently larger than the change-over period of the switch 37. With such an arrangement, the function of the smoothing circuit 38 in the embodiment of FIG. 2 is performed by the integrating amplifier 54 to provide a DC output at the terminal 36. The change-over period of the switch 37 is determined in the same manner as described previously with regard to FIG. 3, and a change in the gain of the amplifier 54 is similarly corrected.

In order to obtain an output of the same polarity as the output from the reference voltage source 31, as described above in connection with FIG. 7, and to omit the smoothing circuit 38, as described above in respect of FIG. 8, use is made of such a circuit arrangement as shown in FIG. 9. The output side of the reference voltage source 31 is connected to the non-inverting input side of the operational amplifier 34 as is the case with FIG. 7, and the integrating capacitor 52 is connected between the inverting input side and the output side of the operational amplifier 34, but its inverting input side is connected via the input resistor 53 to the output side of the switch 37, thus forming the integrating amplifier 54. In this case, the integrating action of the integrating amplifier 54 also achieves the action of the smoothing circuit 38, and at the same time, the integrating amplifier 54 integrates the output from the switch 37 in accordance with the difference thereof from output of the reference voltage source 31 which is provided to the non-inverting input side of the amplifier 54, so that the difference detector 49 of FIG. 7 is omitted. As is the case with FIG. 7, the output at the output terminal 36 and the ground potential are switched alternately and a DC voltage is rendered by the integrating amplifier 54, and the operation is performed so that the value of the DC voltage and the output from the reference voltage source 31 become equal to each other.

The control circuit 41 is not limited specifically to the arrangement shown in FIG. 4 but may also be comprised as shown in FIG. 11 by a comparator 51 in addition to the clock generator 44, with the frequency divider 45 formed by a counter 52 and the flip-flop 47 in FIG. 4 and arranged so that when the count value of the frequency divider 45 reaches a set value of the setting circuit 42, it is detected by the comparator which sets the flip-flop 47 by the detected output. Also, it is possible to repeatedly read a read/write memory using the content of the counter 45 as an address, to write data in the memory only at an address position corresponding to the set value and to set and reset the flip-flop 47 by the read output from the memory and the output from the counter 45. When fabricated as an integrated circuit, the above circuit arrangement requires less elements than those in the arrangement of FIG. 4.

As has been described in the foregoing, according to the reference voltage generator of this invention, even if the output from the reference voltage source itself is not at its reference value, it can be compensated for. Accordingly, it is possible to replace the reference voltage source 31 alone with a new one when it is out of order. In the same manner, when the output from the reference voltage source 31 deviates from its ideal value because of temperature variation or aging, it can also be compensated for.

Further, variations in the output voltage due to deviation of the gain or drift of the DC amplifier 32 or the integrating amplifier 54, in particular, due to changes in the resistance values of the resistors are automatically corrected. Accordingly, the resistors do not require high accuracy and they do not need high stability. The laser trimming of film resistance elements can be omitted and hence they can be produced at low cost and fabricated as an integrated circuit with ease.

The control circuit 41 can be constructed entirely on a digital basis, as described previously with reference to FIG. 4, and clock pulses are available from the clock generator 44 with very high accuracy, so that the change-over ratio of the switch 37 can be set up with very high accuracy. Accordingly, even slight variations can be compensated for sufficiently. Further, if the control circuit 41 is constructed on a digital basis it can be easily fabricated as an integrated circuit. The fact that the change-over ratio can be set up with high accuracy means that very small variations can also be compensated for to provide a reference voltage of very high accuracy. Moreover, by changing the set value of the setting circuit 42 as required, the reference voltage value available at the terminal 36 can be altered as desired; this can be achieved by storing set values corresponding to predetermined reference voltage values and setting a selected one of them in the setting circuit as required.

It will be apparent that many modifications and variations may be effected without departing from the scope of the novel concepts of this invention.

What is claimed is:

1. A reference voltage generator comprising:

a reference voltage source for generating a first reference voltage;

a DC amplifier, comprising an inverting input, connected to the output of the reference voltage source for amplifying the output voltage therefrom to provide a second reference voltage at the output terminal of said DC amplifier;

a switch connected to the output of each of the DC amplifier and the reference voltage source for alternately switching between these outputs and for alternately outputting each one of them;

a smoothing circuit connected to the output of the switch for smoothing said alternating output into a DC voltage and for feeding this DC voltage to the input inverting of the DC amplifier;

a control circuit for controlling the ratio of the periods of said alternating switching, the ratio of the periods being selectively determined by a set value; and setting means for applying the selected set value to the control circuit in such a manner that said ratio results in a corresponding selected value for said second reference voltage.

2. The generator of claim 1, comprising an amplifier connected between said output of the smoothing circuit and the said input of the DC amplifier.

3. A reference voltage generator comprising a reference voltage source for outputting a first reference voltage;

a DC amplifier comprising an operational amplifier with an inverting input and a non-inverting input and an output for outputting an adjustable reference voltage;

a switch connected for alternately switching between said adjustable reference voltage output of said operational amplifier and the output of said reference voltage source, the output of said switch being connected to the inverting input of said operational amplifier; and said DC amplifier comprising an integration means for smoothing said output of said switch, the integration time of said integration means being sufficiently greater than the times of said alternating switching to provide said smoothing for said inverting input of said operational amplifier.

4. A reference voltage generator comprising:

a reference voltage source for generating a first reference voltage;

a DC amplifier comprising an operational amplifier with inverting and non-inverting inputs, said non-inverting input receiving the output from the first reference voltage source, and said DC amplifier outputting an adjustable reference voltage;

a switch for alternately connecting between the output from the DC amplifier and ground potential and to alternately output the corresponding voltage levels;

a smoothing circuit for smoothing the output from the switch;

a difference detector for detecting the difference between the smoothed output and the output from the reference voltage source and for feeding a voltage corresponding to this difference to said inverting input of said operational amplifier;

a control circuit for controlling the periods of said alternating switching, the ratio of said periods being determined by a selected set value to adjust said adjustable reference voltage to a corresponding selected value; and setting means for supplying the selected set value to the control circuit.

5. A reference voltage generator comprising:

a reference voltage source for generating a first reference voltage;

a DC amplifier comprising an operational amplifier with inverting and non-inverting inputs and an output terminal at which a second reference voltage is supplied;

a switch for alternately outputting said output of the operational amplifier and ground potential and to alternately output these voltage signals to said inverting input of said operational amplifier;

said DC amplifier integrating means connected to said inverting input of said operational amplifier for smoothing said output from the switch, the integrating time constant of the integrating means being selected to be sufficiently larger than the periods of said alternating switching of the switch;

a control circuit for controlling the periods of alternation of the switch so that the ratio of the periods is determined by a selected set value; and setting means for applying the selected set value to the control circuit to provide a corresponding selected value of said second reference voltage.

6. A reference voltage generator according to claim 1, 2, 3, 4 or 5, wherein the control circuit comprises a clock generator for generating clock pulses, a frequency-dividing counter for counting the clock pulses, means for outputting a set signal when the count value of the frequency-dividing counter reaches a count value corresponding to the selected set value, and a flip-flop which is set by the set signal output from the frequency-dividing counter to generate the control signal for controlling said alternating switching of the switch.

7. A generator with an adjustable DC output voltage comprising a reference voltage source, a DC amplifier having as one input the output of said reference voltage source, the output of said DC amplifier providing said adjustable DC output voltage, negative feedback means for selectively feeding back said adjustable DC output voltage to said DC amplifier, said negative feedback means including switching means for alternately outputting voltages corresponding to said adjustable DC output voltage and a second voltage level of said generator, control means for adjusting the duty cycle of said switching means for selectively setting said adjustable DC output voltage, and a selected one of said DC amplifier and said negative feedback means comprising smoothing means for smoothing the output of said switching means for said feeding back to said DC amplifier.

8. The generator of claim 7, said DC amplifier comprising an operational amplifier with at least an inverting input, said operational amplifier outputting said adjustable DC output voltage, and said negative feedback means providing a negative feedback corresponding to said smoothed output of said switching means to said inverting input.

9. The generator of claim 8, said adjustable DC output voltage being of opposite polarity than said output of the reference voltage source.

10. The generator of claim 9, said second voltage level of said generator being said output of said reference voltage source.

11. The generator of claim 9 or 10, with a second adjustable DC output voltage of opposite polarity than the first said adjustable DC output voltage, comprising a second DC voltage amplifier having as one input the first adjustable DC output voltage, a second negative feedback means for selectively feeding back said second adjustable DC output voltage to said second DC amplifier, said second negative feedback means including a second switching means for alternately outputting voltages corresponding to said first and second adjustable DC output voltages, second control means for adjusting the duty cycle of said second switching means for selectively setting said second adjustable DC output voltage, and a second smoothing means for smoothing the output of said second switching means.

12. The generator of claim 11, said second DC amplifier including a second operational amplifier with at least an inverting input for receiving a signal corresponding to said smoothed output of said second switching means.

13. The generator of claim 8, said adjustable DC output voltage having the same polarity as said output of the reference voltage source.

14. The generator of claim 13, comprising said operational amplifier being a differential amplifier with a non-inverting input for outputting said adjustable DC output voltage in accordance with the difference in voltage between said inverting and non-inverting inputs, and means for applying a signal corresponding to said output of said reference voltage source to said non-inverting input of said operational amplifier.

15. The generator of claim 14, comprising an inverter for inverting said output of said reference voltage source, and said second voltage level corresponding to the output of said inverter.

16. The generator of claim 14, comprising a difference detector having the smoothed output of the switching means applied to a non-inverting input of said difference detector and said output of the reference voltage source connected to an inverting input of said difference detector, the output of said difference dectector corresponding to the difference between these inverting and non-inverting inputs, and the output of said difference detector being applied to said inverting input of said operational amplifier.

17. The generator of claim 7, said DC amplifier containing said smoothing means as an integrating DC amplifier.

18. The generator of claim 17, said adjustable DC output voltage having opposite polarity as said output of the reference voltage source.

19. The generator of claim 18 said second voltage level being said output of the reference voltage source, so that said input to the DC amplifier of said output of the reference voltage source is through said switching means.

20. The generator of claim 19, said DC amplifier comprising an operational amplifier with inverting and non-inverting inputs and an output corresponding to the difference in voltage between these two inputs, this output corresponding to said adjustable DC output voltage, a capacitor connected between said inverting input and said output of said operational amplifier, and a resistor connected between the output of said switching means and said inverting input of the operational amplifier.

21. The generator of claim 20, the non-inverting input of said operational amplifier being connected to ground potential.

22. The generator of claim 17, said adjustable DC output voltage having the same polarity as said output of the reference voltage source.

23. The generator of claim 22, said second voltage level being ground potential.

24. The generator of claim 23, said DC amplifier comprising an operational amplifier with inverting and non-inverting inputs and an output corresponding to the difference of voltage between these two inputs, this output corresponding to said adjustable DC output voltage, a capacitor connected between said inverting input and the output of said operational amplifier, and a resistor connected between the output of said switching means and said inverting input of the operational amplifier.

25. The generator of claim 24, the non-inverting input of said operational amplifier being connected to said output of the reference voltage source.

26. The generator of claim 7, 8, 10, 13, 14, 17, 18, 20, 22 or 24, said control means comprising a clock for outputting clock pulses, a flip-flop for outputting a signal for determining said duty cycle for said switching, a first frequency divider for resetting said flip-flop, and a second frequency divider for setting said flip-flop according to a set value that is selectively set in said second frequency divider, wherein said duty cycle is determined by said set value.

27. The generator of claim 7, 8, 10, 13, 14, 17, 18, 20, 22 or 24, said control means comprising a clock for outputting clock pulses, a counter for counting said clock pulses, a flip-flop for outputting a signal for determining said duty cycle for said switching means, a comparator for comparing the count of the counter with a selected value and for setting said flip-flop when the count coincides with the selected value.

28. The generator of claim 7, 8, 10, 13, 14, 17, 18, 20, 22 or 24, said DC amplifier and said negative feedback means being integrated on a single semiconductor chip.

29. The generator of claim 28, said control means comprising setting means for selectively setting said duty cycle, said setting means comprising digital switches that can be set manually.

30. The generator of claim 29, at least part of said control means being integrated on said single chip.

31. The generator of claim 14, said second voltage level being ground potential.

32. The generator of claim 7, said second voltage level being selected to be said output of said reference voltage source, so that said one input into said DC amplifier is through said switching means.

* * * * *

UNITED STATES PATENT AND TRADEMARK OFFICE

CERTIFICATE OF CORRECTION

PATENT NO. : 4,367,437

DATED : 4 Jan. 1983

INVENTOR(S) : TSUKASA MIKAMI

It is certified that error appears in the above-identified patent and that said Letters Patent is hereby corrected as shown below:

Column 9, line 37, "input inverting" should be --inverting input--.

Column 10, line 37, after "amplifier" insert --comprising--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*